US005847699A

United States Patent [19]

Kitahara et al.

[11] Patent Number: 5,847,699

[45] Date of Patent: Dec. 8, 1998

[54] KARAOKE DATA PROCESSING SYSTEM AND DATA PROCESSING METHOD

[75] Inventors: Atsushi Kitahara, Tokyo; Hiroshi Tashiro, Tama, both of Japan

[73] Assignee: Sega Enterprises, Ltd., Tokyo, Japan

[21] Appl. No.: 565,889

[22] Filed: Dec. 1, 1995

[30] Foreign Application Priority Data

Dec. 1, 1994 [JP] Japan ..... 6-298568

[51] Int. Cl.[6] ..... G09G 5/24

[52] U.S. Cl. ..... 345/195; 345/192; 434/307 A

[58] Field of Search ..... 345/112, 141, 345/143, 185, 192, 194, 195; 364/DIG. 2, 927.2, 927.4, 928; 395/805; 386/97, 98, 104, 105, 106, 125, 126; 434/307 A

[56] References Cited

U.S. PATENT DOCUMENTS

| | | | |
|---|---|---|---|
| 4,701,746 | 10/1987 | Ueda et al. | 340/347 |
| 4,761,761 | 8/1988 | Sekiguchi | 364/900 |
| 4,954,979 | 9/1990 | Eibner et al. | 364/900 |
| 5,043,712 | 8/1991 | Kihara et al. | 340/735 |
| 5,124,694 | 6/1992 | Dien | 340/750 |
| 5,251,293 | 10/1993 | Ishii et al. | 395/151 |
| 5,336,844 | 8/1994 | Yamauchi et al. | 386/125 |
| 5,367,634 | 11/1994 | Nakamura | 345/194 |
| 5,408,686 | 4/1995 | Mankovitz | 455/66 |
| 5,465,240 | 11/1995 | Mankovitz | 369/1 |
| 5,473,106 | 12/1995 | Miyashita et al. | 84/609 |
| 5,499,921 | 3/1996 | Sone | 434/307 A |
| 5,594,472 | 1/1997 | Date | 345/194 |
| 5,635,657 | 6/1997 | Lee et al. | 434/307 A |
| 5,646,796 | 7/1997 | Kimura et al. | 386/96 |
| 5,652,824 | 7/1997 | Hirayama et al. | 386/126 |

FOREIGN PATENT DOCUMENTS 60-29989 7/1985 Japan .

*Primary Examiner*—Matthew Luu
*Attorney, Agent, or Firm*—Price, Gess & Ubell

[57] ABSTRACT

A simply-constructed data processing system for a karaoke machine can process data to display a plurality of languages. A data processing apparatus processes data composed of one-byte or two-byte character codes, each representing a character. A display can display characters represented by the character codes. A set of font memory can store the character font of each of the character codes for supplying font data. The font memory is divided into four regions, the first to the fourth, according to the combinations of the first two bits of a character code. Japanese characters can be assigned to the first region as the first character group of the first language based on a shift JIS standard, and Hankul characters can be assigned to the fourth region as the second character group of the second language. An identifying apparatus identifies one of the regions to which a character code corresponds, according to the first two bits of a character code.

7 Claims, 7 Drawing Sheets

DETAIL OF

| | FIRST BYTE 40–7E | SECOND BYTE 80–9E | SECOND BYTE 9F–FC |
|---|---|---|---|
| A1 | ORIGINAL KS CODE | A1A1-A1FE | ORIGINAL KS CODE A2A1-A2FE |
| A2 | ORIGINAL KS CODE | A3A1-A3FE | ORIGINAL KS CODE A4A1-A4FE |
| A3 | ORIGINAL KS CODE | A5A1-A5FE | ORIGINAL KS CODE A6A1-A6FE |
| ⋮ | ⋮ | | ⋮ |
| CE | ORIGINAL KS CODE | FBA1-FBFE | ORIGINAL KS CODE FCA1-FCFE |
| CE | ORIGINAL KS CODE | FDA1-FDFE | |

FIG. 4

CHARACTER CODE TABLE

HIGH-ORDER 4 BITS →

↓ LOW-ORDER 4 BITS

| | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 0 | | $D_E$ | | 0 | @ | P | | p | | | | ー | タ | ミ | | |
| 1 | $S_H$ | $D_1$ | ! | 1 | A | Q | a | q | | | 。 | ア | チ | ム | | 円 |
| 2 | $S_X$ | $D_2$ | " | 2 | B | R | b | r | | | 「 | イ | ツ | メ | | 年 |
| 3 | $E_X$ | $D_3$ | # | 3 | C | S | c | s | | | 」 | ウ | テ | モ | | 月 |
| 4 | $E_T$ | $D_4$ | $ | 4 | D | T | d | t | | | 、 | エ | ト | ヤ | | 日 |
| 5 | $E_Q$ | $N_K$ | % | 5 | E | U | e | u | | | ・ | オ | ナ | ユ | | 時 |
| 6 | $A_K$ | $S_N$ | & | 6 | F | V | f | v | | | ヲ | カ | ニ | ヨ | | 分 |
| 7 | $B_L$ | $E_B$ | ' | 7 | G | W | g | w | | | ァ | キ | ヌ | ラ | | 秒 |
| 8 | $B_S$ | $C_N$ | ( | 8 | H | X | h | x | | | ィ | ク | ネ | リ | ♠ | |
| 9 | $H_T$ | $E_M$ | ) | 9 | I | Y | i | y | | | ゥ | ケ | ノ | ル | ♥ | |
| A | $L_F$ | $S_B$ | * | : | J | Z | j | z | | | ェ | コ | ハ | レ | ♦ | |
| B | $H_M$ | $E_C$ | + | ; | K | [ | k | { | | | ォ | サ | ヒ | ロ | ♣ | |
| C | $C_L$ | → | , | < | L | ¥ | l | ¦ | | | ャ | シ | フ | ワ | ● | |
| D | $C_R$ | ← | − | = | M | ] | m | } | | | ュ | ス | ヘ | ン | ○ | |
| E | $S_O$ | ↑ | . | > | N | ^ | n | ~ | | | ョ | セ | ホ | ・ | | |
| F | $S_I$ | ↓ | / | ? | O | _ | o | | | | ッ | ソ | マ | ° | | |

FIG. 6

| Roni Cell Hex code | C G-Hanzi | C T-Hanzi | J Kanji | K Hanja |
|---|---|---|---|---|
| 082000 5200 | 0-3536 0-2122 | 1-442E 1-3514 | 0-4551 0-3755 | 0-535F 0-5179 |
| 082001 5201 | 0-3573 0-2153 | 1-442F 1-3515 | 1-3330 1-1916 | 1-6C73 1-7533 |
| 082002 5202 | 0-5853 0-5854 | | 1-3331 1-1917 | |
| 082003 5203 | 0-4350 0-4012 | 1-4443 1-3535 | 0-3F4F 0-3147 | 0-8C53 0-7551 |
| 082004 5204 | | E-2135 E-0122 | 0-5163 0-4967 | |
| 082005 5205 | | E-2152 E-0150 | 1-3332 1-1913 | |

KARAOKE DATA PROCESSING SYSTEM AND DATA PROCESSING METHOD

BACKGROUND OF THE INVENTION

1. Field of the Invention

This invention relates to a simply-constructed data processing system and a data processing method for processing a plurality of different one- and two-byte codes representative of languages and, more particularly, is suitable for an economical karaoke system.

2. Description of Related Art

In many cases, it is necessary for a computer to process character string data coded in a plurality of verbal languages. As karaoke systems become more popular around the world, there is a growing need for a karaoke system which can be used with many languages. At the same time, there is a strong need for a karaoke system which allows many people to specify song names, retrieve song information, and display words in their own language so that people from many countries can enjoy karaoke in the same place with the same display screen.

A computer capable of processing a plurality of languages must be able to process all the characters in those languages according to some specific encoding method. This requires the computer to convert characters into a binary code system consisting of a specific number of bits. This processing is called encoding. One of those basic codes is the Alpha-Numeric and Kana (ANK) code shown in FIG. 4.

As shown in FIG. 4, each character in this ANK code is represented by an eight-bit (one byte) character code. An eight-bit character code corresponding to each character is represented by two-dimensional (i.e., horizontal and vertical) coordinate values according to the position within the ANK code table where the character is described. That is, in the ANK code, the high-order four bits of an eight-bit character code represent a horizontal coordinate value, and the low-order four bits a vertical coordinate value. These two coordinate values each are represented by hexadecimal numbers consisting of 10 numeric characters, 0 to 9, and six alphabetic characters, A to F. For example, in the ANK code, the character code corresponding to the kana character ア is represented by the hexadecimal number B1(H), because the horizontal coordinate value of that kana character is B and the vertical coordinate value is 1.

The problem with the ANK code is that, although it includes almost all the characters necessary for English (uppercase and lowercase alphabetic characters, numeric characters, and special symbols), it is not suitable for Japanese because it includes only katakana characters. This is because the required number of characters varies among languages.

More specifically, about 200 characters, including uppercase/lowercase alphabetic characters and special symbols, are used in English, while katakana characters, as well as hiragana and about 7000 kanji characters, are used in Japanese. In many Asian countries, a language consists of many characters. For example, Korean requires at least about 2300 commonly-used Hankul characters which are combinations of initial sounds, intermediate sounds, and end sounds.

Therefore, for languages such as Japanese and Chinese which use kanji characters or Korean which uses Hankul characters, it is impossible to uniquely identify all the characters with the use of the eight-bit ANK code because those languages use a large number of characters. To solve this problem, the 16-bit (two bytes) binary code, capable of representing more characters, has been used to encode each kanji and Hankul character.

An example of two-byte code system is the shift JIS (Japanese Industrial Standard) code, the standard for Japanese kanji characters. The shift JIS code is created by shifting the character definition position of a character while retaining the JIS code contents defined by JIS C6226. That is, in the shift JIS code, the first byte of the two bytes of each kanji character is moved from its definition position to an undefined area not used in the ANK code. The second byte is then moved to a position within the ANK code where an ANK code control character, symbol, or space is not defined. This method makes it possible to identify, from the first byte of each kanji character code, that the character code is a Japanese kanji character.

Other known two-byte code systems include GB 2312-80, the Chinese character standard, which is used to represent about 7500 Chinese kanji characters, and KS C5601, the Hankul character standard, which is used to represent about 2600 Hankul characters and about 3000 kanji characters.

However, these two-byte code systems, each with its own code setting, cannot be used on the same computer. In addition, the international encoding character set (ISO 10646-1/FIG. 5), which uses 32 bits to represent a large number of characters, is complex in processing. To solve these problems, Unicode was proposed recently as the standard to allow a plurality of languages to be used on the same computer.

Unicode is a 16-bit (two bytes) code system proposed by American National Standards Institute (ANSI). Unicode, which has a large code table called a basic lingual plane consisting of 256×256 combinations, is designed to represent the character code settings of all the languages in this basic lingual plane alone. In this Unicode, some equivalent but different-shaped kanji code characters, such as Japanese 葛 and Chinese 葛 are treated as same-shaped characters. These different-shaped characters are represented by a common code called a CJK (Chinese-Japanese-Korean) integrated kanji code.

However, there are the following problems with a Unicode-implemented data processing system which processes a plurality of languages. The special code used for Unicode, which is incompatible with the conventional code systems, makes it impossible to utilize the existing resources.

In addition, because Unicode uses only one large basic multi-lingual plane for all the characters of all the languages, the amount of data increases and the system construction becomes complex.

Another problem is that slight differences between a plurality of languages are sometimes ignored. In the CJK integrated kanji code described above, a plurality of different-shaped characters, used in Japanese, Korean, and Chinese, are integrated into one kanji character. Therefore, it is impossible to differentiate between kanji characters that are slightly different among languages. FIG. 6 shows an example of different-shaped characters.

As a result, when displaying data in one of the above three languages, different-shaped characters, which are not used in that language, sometimes appear in the displayed data.

Thus, in the prior art, it is impossible to process a plurality of two-byte languages, such as Japanese, Korean, Chinese, etc., on a computer at the same time.

This invention seeks to solve the problems associated with a prior art described above.

OBJECTS AND SUMMARY OF THE INVENTION

It is an object of this invention to provide a simply-constructed data processing system which processes a plurality of languages. It is another object of this invention to provide a data processing system which processes a plurality of languages and, in addition, differentiates between different-shaped characters. It is still another object of this invention to provide a data processing system which process a plurality of languages while utilizing the existing resources.

In order to accomplish the above objects, the present invention provides a data processing system comprising: processing means for processing data containing character codes each representing a character; and displaying means for displaying characters represented by the character codes, wherein there is at least one set of font memory for storing a character font for each of the character codes and for supplying font data to the displaying means, the font memory is divided into a plurality of regions according to the combinations of a specified number of bits of a character code, and the font of the character group of a different language is assigned to each region.

The invention from a methodological standpoint is a data processing method comprising: a step for processing data containing character codes each representing a character; and a step for displaying characters represented by the character codes, wherein there is at least one set of font memory for storing a character font for each of the character codes and for supplying font data to the displaying step, the font memory is divided into a plurality of regions according to the combinations of a specified number of bits of a character code, and the font of the character group of a different language is assigned to each region. The font memory is divided into a plurality of regions according to the combinations of the specified number of bits of a character code, and the character group of a different language is assigned to each region. This enables the character types of a plurality of languages to be represented and processed. In addition, the code of a character group does not duplicate that of another character group and, therefore, a unique code is assigned to each of the different-shaped characters. This prevents the different-shaped characters from being treated as the same code.

The font memory is divided into four regions according to the combinations of the first two bits of a two-byte character code. The first character group is assigned to the first region, and the second character group to the second region. This enables a two-byte character code to represent and process the character types of a plurality of languages. In addition, the first character group does not duplicate the second character group and, therefore, a unique character code is assigned to each of the different-shaped characters. This prevents the different-shaped characters from being treated as the same code. An identifying means for identifying one of the regions to which a character code corresponds, according to a specified two bits of the character code is provided.

According to the invention, the character type is easily identified and processed by simply checking the first two bits of a character code. Additionally, one set of the font memory contains the character font of a plurality of characters that can be displayed on the displaying means at the same time. The first and second character groups are in the font regions of characters that can be displayed at the same time. This allows characters from the first character group and those from the second character groups to be displayed at the same time, enabling the user to view characters from both groups at the same time. Thus, character string data either from the first character string data of the first character group or from the corresponding second character string data of the second character group, whichever is desired, is displayed.

Character strings from the first character group are made to correspond to those from the second character group during processing. This gives the user a variety of display options, ensuring a superior display operability; for example, characters from one of the character groups may be displayed selectively, or characters from both character groups may be displayed at the same time. The first character group and the second character group can be Japanese characters, Chinese characters, or Hankul characters.

When Japanese characters, Chinese characters, or Hankul characters are used for the first character group and second character group, those character groups require an equal-level resolution font and, accordingly, the memory area is better utilized.

When a shift JIS standard character code is used as the first character group, this eliminates the need for control codes (for example, IN/OUT code) even when the characters are mixed with one-byte characters. In addition, the existing resources are utilized because the system works well with the existing JIS-compliant hardware and software while maintaining their upward compatibility.

Finally, converting means for converting the character codes of a character group can be implemented and a character code used in this invention may be replaced with a character code based on some other standard. This enables the existing resources, including data, to be better utilized.

Other and further objects, features, and advantages of the invention will appear more fully from the following description.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 4 is an example of the ANK code;

FIG. 6 is an example of different-shaped characters; and

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to disclose a karaoke system with improved data processing.

(1) Construction of the First Embodiment

It is an object of this invention to provide a simply-constructed data processing system which can process a plurality of languages within the constraints of a 16-bit processor hardware system. It is another object of this invention to provide a data processing system which processes a plurality of languages and, in addition, differentiates different-shaped characters. It is still another object of this invention to provide a data processing system which processes a plurality of languages while utilizing the existing resources.

Figure 1:
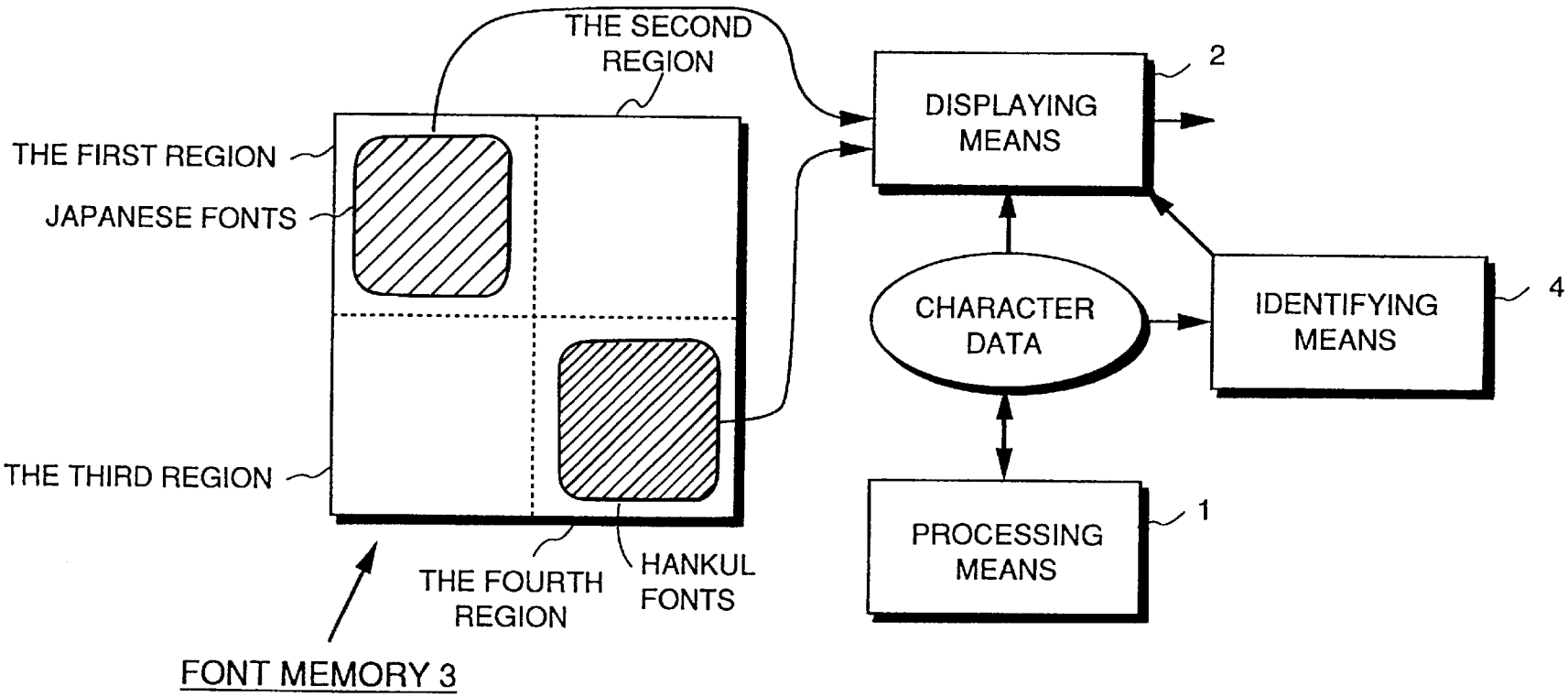
FIG. 1 is a functional block diagram showing the construction of the first embodiment of this invention.

FIG. 1 is a functional block diagram showing the construction of the data processing system (hereafter called this system) used in this embodiment. As shown in this figure, this system is a data processing system comprising the processing means 1 for processing data consisting of one-byte or two-byte character code data and the displaying means 2 for displaying characters represented by the character code. The processing means 1 contains a memory device, processing routines, and an input device.

In addition, this system has a set of font memory 3 where a character font for each character code is stored, the font memory being divided into four regions, 1 to 4, according to the combinations of the first two bits of a character code. Region 1 contains the Japanese characters as the first character group of the first language, and region 4 contains the Hankul characters as the second character group of the second language. The font memory 3, which holds a plurality of characters that can be displayed on the displaying means 2 at the same time, contains JIS C 6226 as the Japanese characters. This system also has the identifying means 4 for identifying a region to which each character code corresponds, according to the first two bits of a character code.

(2) Operation and Effect of the First Embodiment

The first embodiment having the construction described above performs operation as follows. When a character is displayed in this system, the identifying means 4 checks the first two bits of a character code to identify the region to which the character code corresponds and, based on this result, displays the font contained in the corresponding region on the displaying means 2. An input to the identifying means, such as a selection from a user, can specify the desired language in two bits to enable a comparison for specifying a particular region.

This embodiment assigns the first character group to the first region, and the second character group to the second region, resulting in a simple construction where a plurality of language character types are represented and processed using only two-byte character codes. In addition, this embodiment, which uses a unique code for each of the first and second character groups, allows different character codes to be assigned to different-shaped characters and, therefore, prevents different-shaped characters from being treated as the same character code.

This embodiment also allows a character type to be identified and processed by checking the first two bits of a character code. Also, this embodiment allocates the first and second character groups to the font regions so that characters from the first group and those from the second group are displayed at the same time, enabling the user to view characters from both groups at the same time.

In addition, because the first character group is Japanese and the second character group is Hankul in this embodiment, and because both character groups require an equal-level resolution font, the memory area is better utilized.

As shown in FIG. 4, this allows the system to process one-byte character codes or two-byte character codes, depending on whether the first byte processed represents a valid character in the 8-bit-addressable character space. If the first byte represents a valid character, the next byte is treated as the first byte of the next character. If the first byte, however, represents a designated shift character, then the second byte is processed to determine the character represented by the two-byte character code. Thus, this embodiment can be used with existing one-byte hardware and software or with expanded two-byte character codes.

Figure 5:
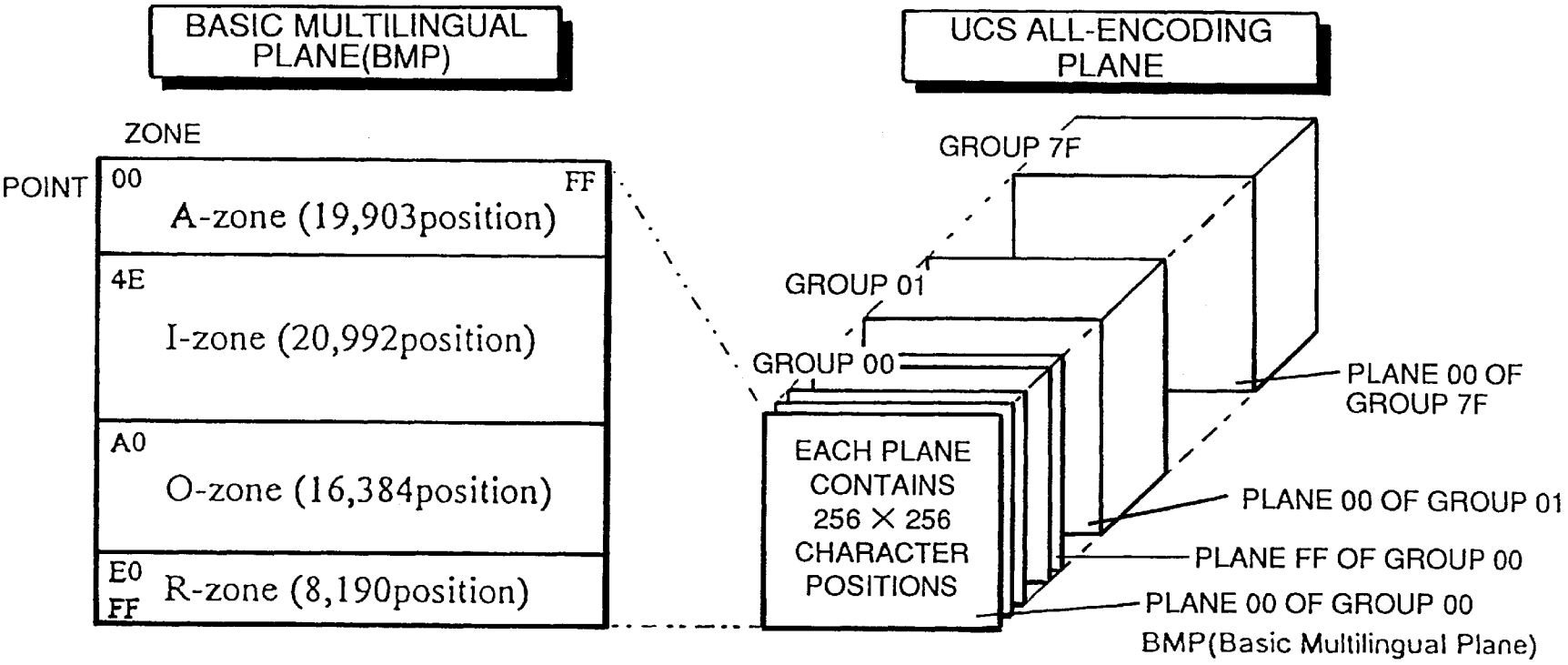
FIG. 5 is a conceptual diagram showing the structure of the international encoding character set.

FIG. 5 represents examples of character mapping.

This embodiment uses the JIS standard font in the first character group, allowing this system to work well with the existing JIS-compliant hardware and software and, therefore, utilizing the existing resources.

Figure 7:
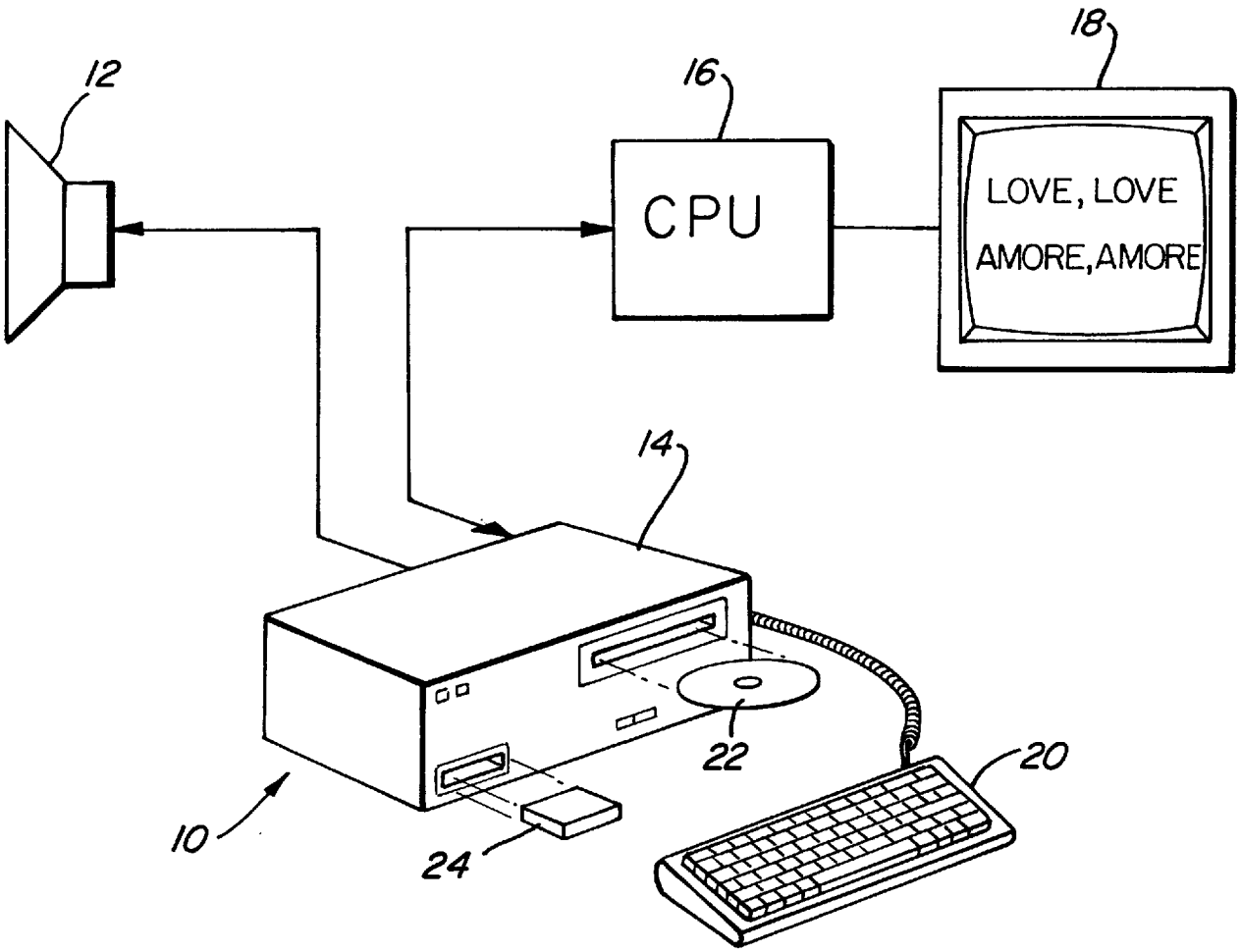
FIG. 7 is a schematic example of a karaoke system incorporating the present invention.

Referring to FIG. 7, a schematic illustration of the karaoke system 10 is disclosed. A player 14 can receive a CD-ROM 22 containing character string data coded to enable the display of a plurality of different languages on a CRT screen 18. The player 14 can also receive a memory font cartridge 24 that can be customized to provide a font memory of the particular languages desired. Thus, font memory 3 could be installed as a cartridge memory 24. The song data to be processed can be provided on the CD-ROM 22. A computer system 16 can control the data processing to enable the display of languages, including the simultaneous display of multiple languages, on the CRT screen 18. As only one example of an input, a keyboard 20 is disclosed that would permit the user to specify a particular language, which would thereby permit the identifying means 4 to interact with the character data for accessing a particular region of the font memory 3. Since the data processing system of the present invention enables a generic provision of a font memory to accommodate either a one-byte or two-byte character code system, conventional hardware can be utilized, and the programming can be simplified. Additionally, the karaoke machine can receive replacement font cartridges 24 to accommodate different languages.

To provide additional background information, reference can be made to the copending application, Ser. No. 08/448,664, entitled "AN EFFECT CONTROL METHOD, AN EFFECT CONTROL DEVICE AND A KARAOKE SYSTEM USING SUCH METHOD AND DEVICE," filed on May 24, 1995 and incorporated herein by reference.

(3) Second Embodiment

Figure 2:
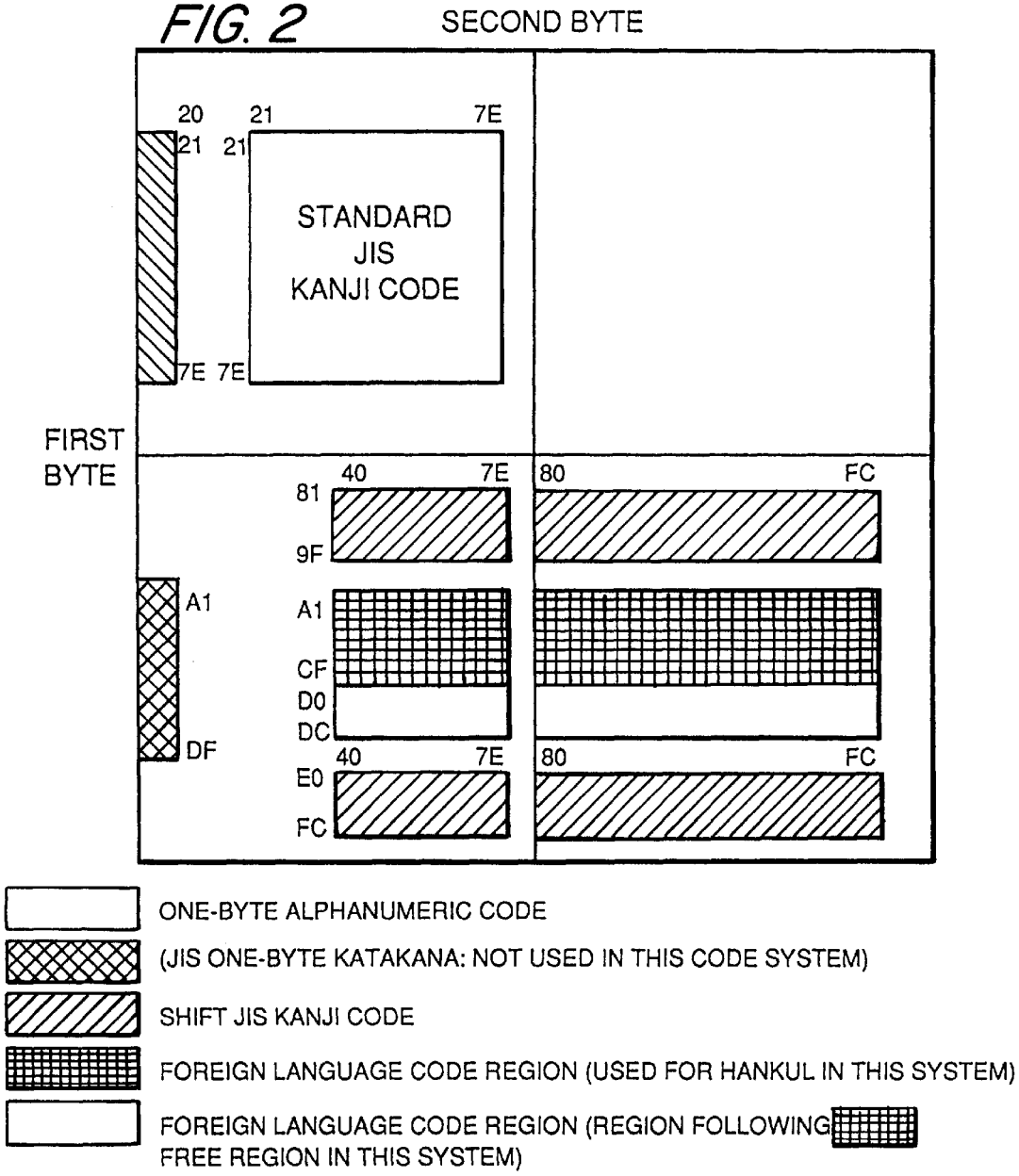
FIG. 2 is a diagram showing the code assignment used in the second embodiment of this invention.

The shift JIS standard (X 0208-1990, etc.) code may be used as the first character group. FIG. 2 shows the character code assignment used in the second embodiment. As shown in FIG. 2, one-byte katakana characters (hexadecimal numbers 80h to DFh) are removed and, in the resulting vacated region, a desired language (Korean in this example) code is assigned, in the same manner as the JIS code is changed to the shift JIS code. (In the figure, the assigned Korean code is abbreviated to the original KS code.) Here, the shift JIS code is used in the JIS code corresponding part, and the KS code corresponding part is shifted to the region whose first bytes range from A0h to CFh. Note that, even if there is no one-byte katakana characters, two-byte katakana characters are used to display katakana characters. Also note that the region in the vacated region whose first bytes are DDh, DEh, and DFh are not used for a foreign language code to make the foreign language region equal in size to the shift JIS standard code region.

As described above, the Korean KS code or the Chinese GB code, which does not duplicate the JIS code, may be used in an embodiment of this invention. Therefore, this invention is particularly suited to a karaoke system which displays both Japanese and Hankul characters at the same time. This invention eliminates the need for control codes (for example, IN/OUT code) even when one-byte characters and two-byte characters are mixed. In addition, the existing resources are utilized because this system works well with the existing JIS-compliant hardware and software while maintaining their upward compatibility. The second embodiment which has the features described above may be applied, for example, to a communication karaoke using the shift JIS communication protocol.

(4) Other Embodiments

This invention is not restricted to the preferred embodiments described above, but may be embodied in other specific forms, such as those described below, without departing from the spirit or essential characteristics thereof.

For example, although the character codes may be read by a special input program, they may be converted from other character codes; this method saves the input step. More specifically, the Japanese characters entered as JIS standard C 6226-1978 character codes may be converted to the shift JIS standard character codes by a converter program, or the characters entered as the Korean KS-C 5601 standard character codes may be assigned to the area specified in the above embodiment. Reverse conversion is also possible. This enables the existing resources, including data, to be better utilized.

A character group to be assigned to each region is not limited to the Japanese, Chinese, or Hankul character group, but the character group of any other language may be assigned. When selecting the first character group and second character group from Japanese, Chinese, and Hankul, any combination (Japanese characters and Chinese characters, Chinese characters and Hankul characters, etc.) is possible.

Figure 3:
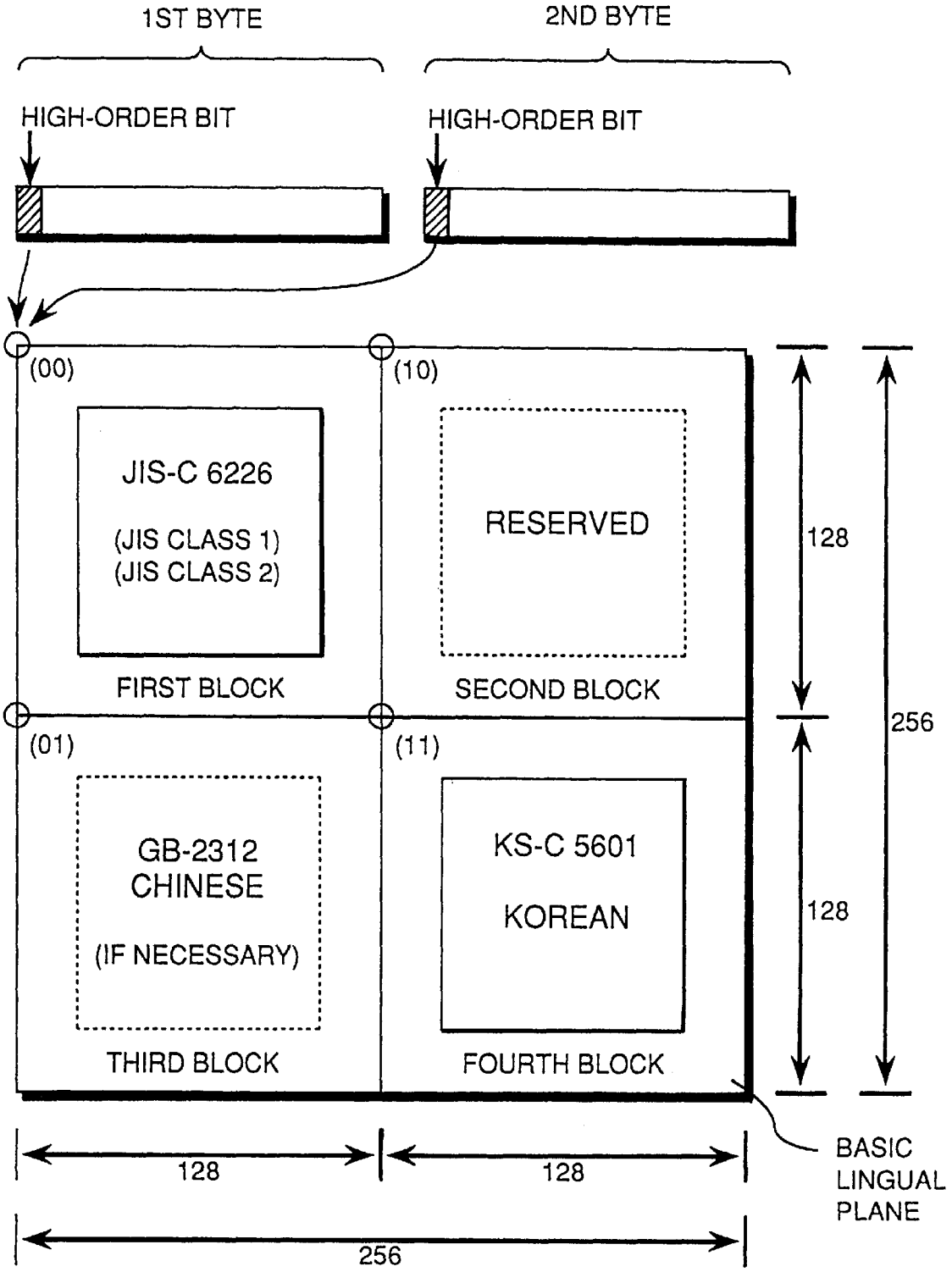
FIG. 3 is a conceptual diagram in which the Chinese characters are assigned to the third region of the data processing system in the embodiment of this invention.

In China, GB 2312-80 (G0) is the only standard available today. FIG. 3 shows an example in which the Chinese GB 2312 standard code is assigned to the third region (third block) in the first embodiment described above. There are also draft standards G1, G3, G5, G7, and G8; when standards G1 to G8 are used in the future, a multilayer lingual plane, which allows a layer to be switched to another, may be applied to those standards.

A system according to this invention may be constructed so that a character string either from the first character string data of the first character group or from the corresponding second character string data of the second character group, whichever is desired, may be displayed. This method gives the user a variety of display options, ensuring a superior display operability; for example, one of Japanese characters and Korean characters may be displayed selectively, or both may be displayed at the same time.

As described above, this invention provides a simply-constructed data processing system which processes a plurality of languages.

While a preferred embodiment has been described, variations thereto will occur to those skilled in the art within the scope of the present inventive concepts which are delineated by the following claims.

What is claimed is:

1. A karaoke system for displaying a plurality of different languages comprising:

storing means for storing character data representative of a song;

a player for removably receiving the storing means and reading the character data;

means for specifying a specific language;

a removable memory font for storing a plurality of different character codes representative of different languages, the memory font being divided into regions wherein the means for specifying will define a particular region, the character codes stored in a region can be addressed by a first byte from the character data after being specified by two bits of the character data, a subsequent second byte can address character codes in different regions; and means for processing and displaying the language from the selected character codes and character data.

2. A karaoke machine for displaying text in a plurality of languages comprising:

processing means for processing data containing character codes, each character code representing a character and being either one-bytes or two-bytes in length, wherein the processing means processes one byte of data when the one byte of data represents a valid character in an eight-bit character space and processes two bytes of data, a first byte and a second byte, when the first byte represents a designated shift character in the eight-bit character space;

displaying means for displaying characters represented by the character codes;

font memory means for storing a character font for each of the character codes, the font memory means being divided into a plurality of regions according to the combinations of a specified number of bits of a character code; and identifying means for identifying one of the plurality of regions to which a character code corresponds, according to a specified two bits of the character code.

3. A karaoke system for displaying a plurality of different languages comprising:

storing means for storing character data representative of a song;

a player for removably receiving the storing means and reading the character data;

means for specifying a specific language;

a font memory for storing a plurality of different character codes representative of different languages, the font memory being divided into regions wherein the means for specifying will define a particular region; and means for processing and displaying the language from the selected character codes and character data.

4. A karaoke system for displaying a plurality of different languages comprising:

storing means for storing character data representative of the lyrics of a song;

a player for reading the character data stored on the storing means;

means for specifying a desired language;

a font memory for storing a plurality of different character codes representative of different languages, the font memory being divided into regions wherein the means for specifying will define a particular region; and means for processing and displaying the language from the selected character codes and character data.

5. The karaoke system of claim 4, wherein a Two-Byte Shift JIS character code is stored in a first region.

6. The karaoke system of claim 5, wherein One-Byte Katakana codes are removed from the Two-Byte Shift JIS region creating a vacancy, and a foreign language is stored in the vacancy.

7. The karaoke system of claim 6, wherein character addresses of the foreign language are directly specified in the character data stored in the storing means.

* * * * *